US009905960B2

(12) United States Patent
Liang et al.

(10) Patent No.: US 9,905,960 B2
(45) Date of Patent: Feb. 27, 2018

(54) ELECTRICAL CONNECTOR

(71) Applicant: ALLTOP ELECTRONICS (SUZHOU) LTD., Suzhou, JiangSu (CN)

(72) Inventors: Lili Liang, Suzhou (CN); Yonggang Zhang, Suzhou (CN); Yuhui Zhang, Suzhou (CN)

(73) Assignee: ALLTOP ELECTRONICS (SUZHOU) LTD., Suzhou, Jiangsu (CN)

( * ) Notice: Subject to any disclaimer, the term of this patent is extended or adjusted under 35 U.S.C. 154(b) by 0 days.

(21) Appl. No.: 15/127,953

(22) PCT Filed: Jan. 15, 2016

(86) PCT No.: PCT/CN2016/071045

§ 371 (c)(1),
(2) Date: Sep. 21, 2016

(87) PCT Pub. No.: WO2016/192398

PCT Pub. Date: Dec. 8, 2016

(65) Prior Publication Data

US 2017/0098907 A1 Apr. 6, 2017

(30) Foreign Application Priority Data

Jun. 4, 2015 (CN) ..... 2015 1 0304995

(51) Int. Cl.
*H01R 13/52* (2006.01)
*H01R 13/405* (2006.01)

(52) U.S. Cl.
CPC ..... *H01R 13/521* (2013.01); *H01R 13/405* (2013.01)

(58) Field of Classification Search
CPC ..... H01R 13/521
USPC ..... 439/272, 273, 587, 589
See application file for complete search history.

(56) References Cited

U.S. PATENT DOCUMENTS 3,721,943 A * 3/1973 Curr ..... H01R 13/426 439/273
4,109,989 A * 8/1978 Snyder, Jr. ..... G02B 6/3849 439/140
4,116,521 A * 9/1978 Herrmann, Jr. ..... H01R 13/53 439/274
4,808,115 A * 2/1989 Norton ..... G02B 6/381 361/721

(Continued)

*Primary Examiner* — Neil Abrams
(74) *Attorney, Agent, or Firm* — Sughrue Mion, PLLC

(57) ABSTRACT

An electrical connector having an insulative housing having a mating cavity and a plurality of passageways, a plurality of electrical contacts received in the corresponding passageways and a sealing member received in the mating cavity. The insulative housing defines a front face and a mounting wall, the mating cavity is formed between the front face and the mounting wall. Each electrical contact has a contacting portion, a tail portion, and a main portion connecting the contacting portion with the tail portion, each main portion defines a plurality of barbs on both sides thereof. The sealing member has a base portion and at least one opening defined in the base portion for tail portions passing through. At least one electrical contact defines a wing on one side thereof, and the sealing member is restricted between the wing and the mounting wall.

13 Claims, 11 Drawing Sheets

(56) References Cited

U.S. PATENT DOCUMENTS

| | | | | | |
|---|---|---|---|---|---|
| 4,874,326 | A * | 10/1989 | Marolda, Jr. | H01R 13/523 | 439/273 |
| 4,932,875 | A * | 6/1990 | Ogawa | H01R 13/5221 | 439/271 |
| 5,151,045 | A * | 9/1992 | Cravens | H01R 13/5202 | 439/271 |
| 5,535,512 | A * | 7/1996 | Armogan | H01R 13/5202 | 29/877 |
| 5,586,897 | A * | 12/1996 | Shinji | H01R 13/5219 | 439/271 |
| 6,036,521 | A * | 3/2000 | Tabor | H01R 13/5221 | 439/272 |
| 6,334,785 | B2 * | 1/2002 | Miwa | H01R 13/521 | 439/272 |
| 6,866,529 | B2 * | 3/2005 | Hobson | H01R 13/5202 | 439/271 |
| 7,255,585 | B2 * | 8/2007 | Kameyama | H01R 13/5219 | 439/271 |
| 7,445,481 | B2 * | 11/2008 | Nagashima | H01R 13/521 | 439/276 |
| 7,618,287 | B2 * | 11/2009 | Hass | H01R 13/443 | 439/272 |
| 8,734,174 | B2 * | 5/2014 | Nakamura | H01R 13/504 | 439/271 |
| 9,431,735 | B2 * | 8/2016 | Yu | H01R 13/521 | |
| 9,577,368 | B2 * | 2/2017 | Fukuda | H01R 13/03 | |
| 9,608,363 | B2 * | 3/2017 | Greene | H01R 13/521 | |
| 2015/0200485 | A1 * | 7/2015 | Yu | H01R 13/521 | 439/521 |
| 2017/0098907 | A1 * | 4/2017 | Liang | H01R 13/521 | |

* cited by examiner

ELECTRICAL CONNECTOR

CROSS REFERENCE OF THE RELATED APPLICATIONS

This application is a National Stage of International Application No. PCT/CN 2016/071045, filed on Jan. 15, 2016, claiming priority to Chinese patent application No. 201510304995.5, filed on Jun. 4, 2015 and with the title of "electrical connector", which is incorporated herein by reference in its entirety.

TECHNICAL FIELD

The present invention relates to an electrical connector, and more particularly to an electrical connector used in an electric car.

BACKGROUND ARTS

A conventional electrical connector assembly used for an electric car includes a plug and a receptacle mating with each other, the plug has a mating portion, and the receptacle has a receiving space for receiving the mating portion of the plug. To realize a waterproof property, the electrical connector assembly defines a sealing member between the mating portion and the receiving space. The sealing member is usually fixed by a bolt or a plastic locking member, to achieve a firm sealing effect. However, the two configurations of fixation are required additional elements to achieve the fixation of the sealing member.

Hence, an improved sealing member of the electrical connector is highly desired to overcome the disadvantages of the related art.

SUMMARY

One objective of the present application is to provide an electrical connector having a self-positioning sealing member without any auxiliary element for better waterproof purpose.

To realize the above objective, the present application provides an electrical connector comprising an insulative housing having a mating cavity and a plurality of passageways, a plurality of electrical contacts received in the corresponding passageways and a sealing member received in the mating cavity. The insulative housing defines a front face and a mounting wall, the mating cavity is formed between the front face and the mounting wall for accommodating the complementary connector. The passageways are penetrating through the mounting wall along a mating direction. Each electrical contact comprises a contacting portion, a tail portion, and a main portion connecting the contacting portion with the tail portion each main portion defines a plurality of barbs on both sides thereof for interferentially engaging with the corresponding passageway. The sealing member has a base portion and at least one opening defined in the base portion for tail portions of electrical contacts passing through. At least one electrical contact defines a wing on one side thereof, and the sealing member is restricted between the wing and the mounting wall.

DETAILED DESCRIPTION

Figure 1:
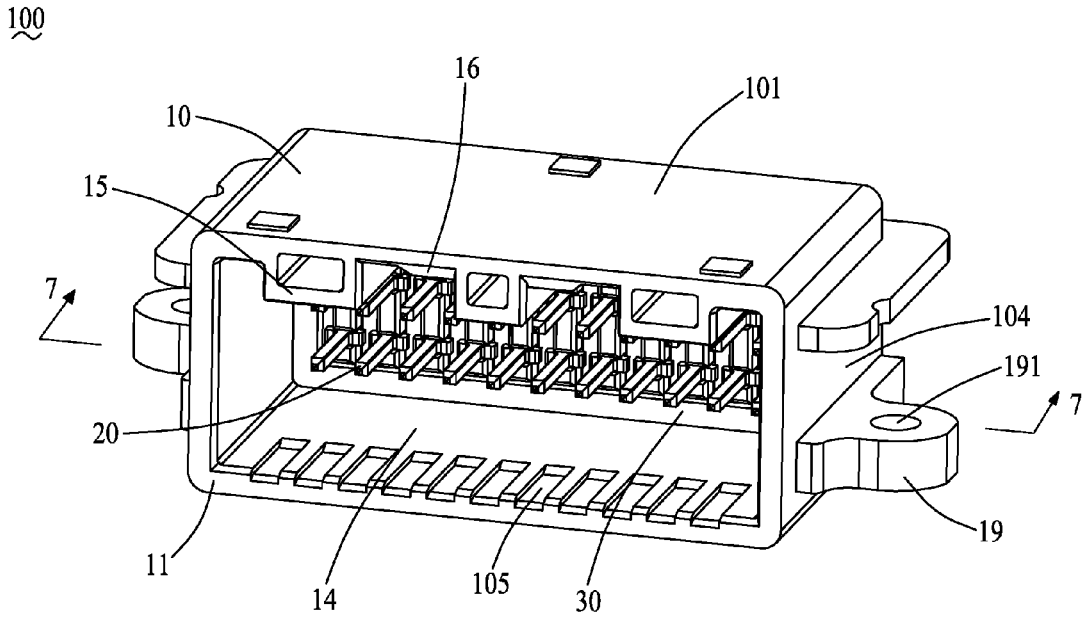
FIG. 1 is a perspective view of an electrical connector in accordance with a first embodiment of the present invention.

Reference will be made to the drawing figures to describe the present invention in detail, wherein depicted elements are not necessarily shown to scale and wherein like of similar elements are designated by same or similar reference numeral through the several views and same or similar terminology.

Figure 2:
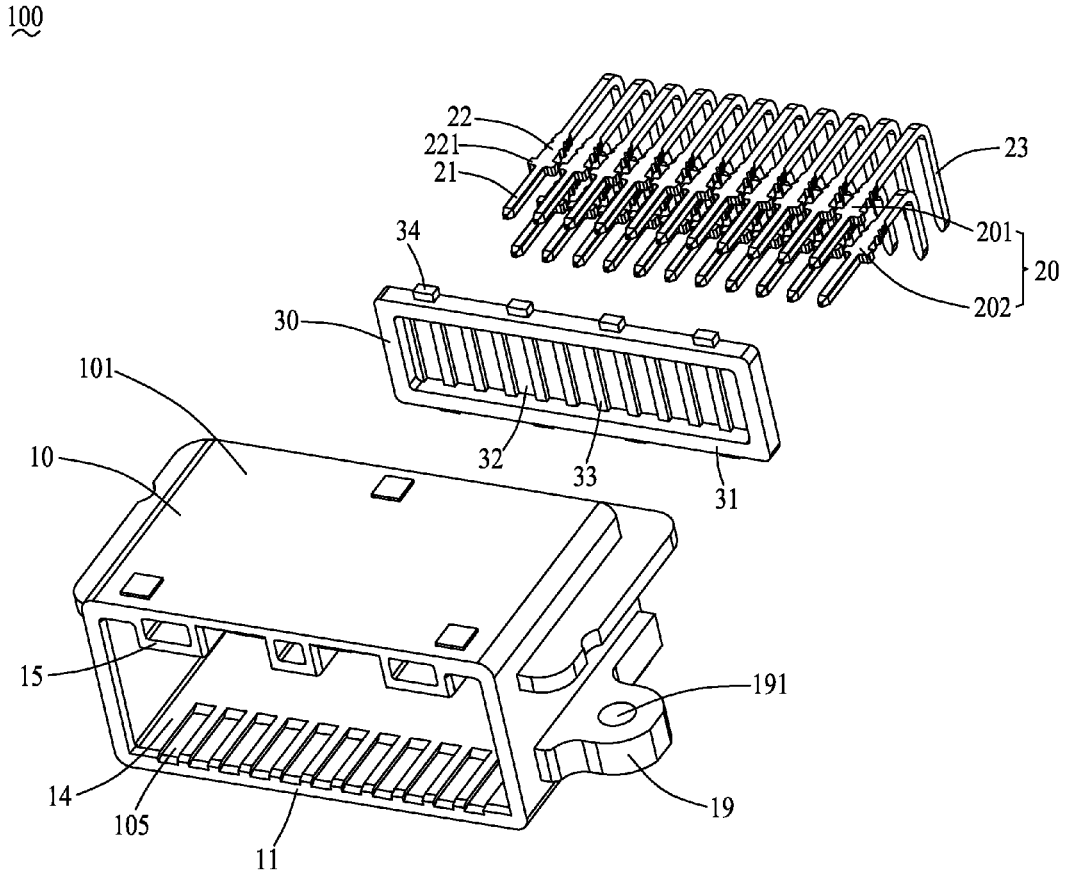
FIG. 2 is an exploded perspective view of the electrical connector shown in FIG. 1.

Please referring to FIG. 1 and FIG. 2, in a first embodiment, the present invention is directed to an electrical connector 100 mounting to a printed circuit board (not shown) for mating with complementary connector (not shown). The electrical connector 100 comprises an insulative housing 10, a plurality of electrical contacts 20 received in the insulative housing 10, and a sealing member 30 received in the insulative housing 10, the sealing member 30 is retained between the insulative housing 10 and the electrical contacts 20 to provide a better waterproof performance.

Figure 3:
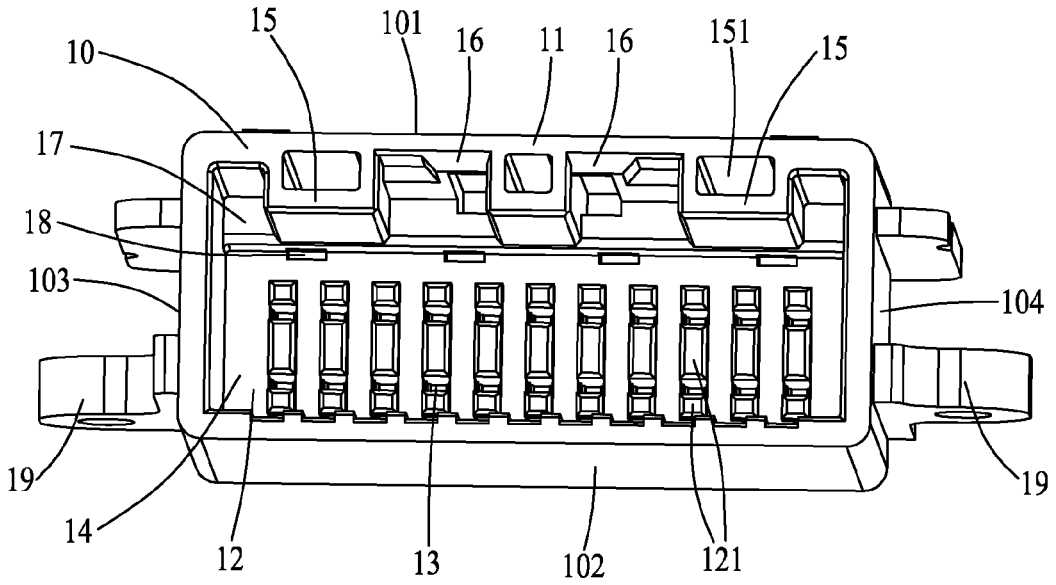
FIG. 3 is a perspective view of an insulative housing of the electrical connector shown in FIG. 2.
Figure 4:
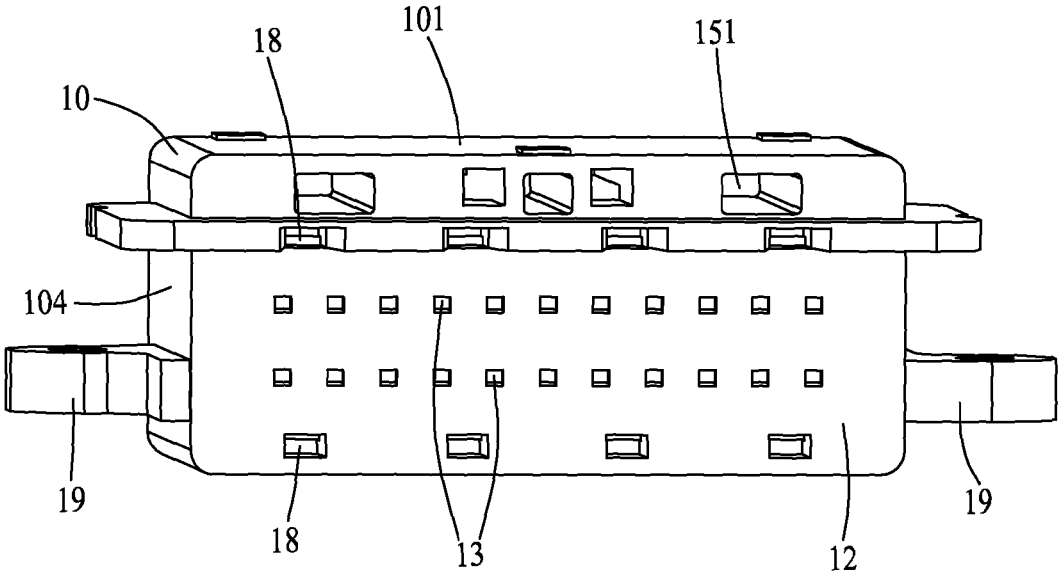
FIG. 4 is a view similar to FIG. 3, but viewed from another aspect.

Please referring to FIGS. 3-4 and conjunction with FIG. 2, the insulative housing 10 defines a front face 11 for mating with the complementary connector, a mounting wall 12 opposite to the front face 11, a plurality of passageways 13 extending from the front face 11 to the mounting wall 12. The passageways 13 penetrate through the front face 11 and the mounting wall 12 along a mating direction.

A mating cavity 14 is formed between the front face 11 and the mounting wall 12 for accommodating the complementary connector, furthermore, the mating cavity 14 is extending through the front face 11 and communicated with the passageways 13, for the electrical contacts 20 electrically connected with the complementary connector therein. The insulative housing 10 comprises a top wall 101, a bottom wall 102 opposite to the top wall 101, a left side wall 103 and a right side wall 104 connecting the top wall 101 with the bottom wall 102 to form the mating cavity 14.

Three protrusions 15 are extending towards the bottom wall 102 from an inner face of the top wall 101, a retaining portion 16 is disposed between every two neighboring protrusions 15, and the retaining portion 16 extends along a direction same as the protrusion 15. The retaining portion 16 has a thickness less than that of the protrusion 15 along a height direction of the electrical connector 100, the protrusions 15 and the retaining portions 16 could contact with the complementary connector, to establish a stable combination between the electrical connector 100 and the complementary connector. Each protrusion 15 defines an aperture 151 recessed backwards from the front face 11, to provide a function of buffering while the electrical connector 100 mating with the complementary connector.

The insulative housing 10 also has a beam 17 located behind the protrusions 15, the beam 17 is connected the protrusions 15 and the mounting wall 12. A group of limiting slots 18 are defined in a conjunction area between the mounting wall 12 and a lower surface of the beam 17, thus the limiting slots 18 are located below the protrusions 15 and recessed backwards from the mounting wall 12. Another group of limiting slots 18 are defined in a conjunction area between the bottom wall 102 and the mounting wall 12, and the two groups of limiting slots 18 are opposite to each other. In other selectable embodiment, the insulative housing 10 also can be defined without the protrusions 15, the retaining portions 16 and the beam 17, meanwhile, the limiting slots 18 could be disposed in a conjunction area between the mounting wall 12 and the top wall 101, and a conjunction area between the mounting wall 12 and the bottom wall 102.

The bottom wall 102 defines a plurality of grooves 105 recessed backwards from the front face 11, and the grooves 105 are communicated with the mating cavity 14 for matching with the complementary connector. Each of the left side wall 103 and the right side wall 104 defines an ear portion 19 on an outer surface thereof, for installing the electrical connector 100 on the printed circuit board. The ear portion 19 on the left side wall 103 and the ear portion 19 on the right side wall 104 are offset along the mating direction, furthermore, the two ear portions 19 are disposed diagonally on both sides of the insulative housing 10. Each ear portion 19 defines a through hole 191 extending along the height direction, for a bolt (not shown) being inserted into to fasten the electrical connector 100 with the printed circuit board.

The passageways 13 are defined through the mounting wall 12, and divided into two rows along the height direction. The mounting wall 12 defines a plurality of ribs 121 aligned with the corresponding passageway 13, the ribs 121 are extending forwards into the mating cavity 14, and each rib 121 is divided into three segments by two relative passageways 13 along the height direction of the insulative housing 10.

Figure 5:
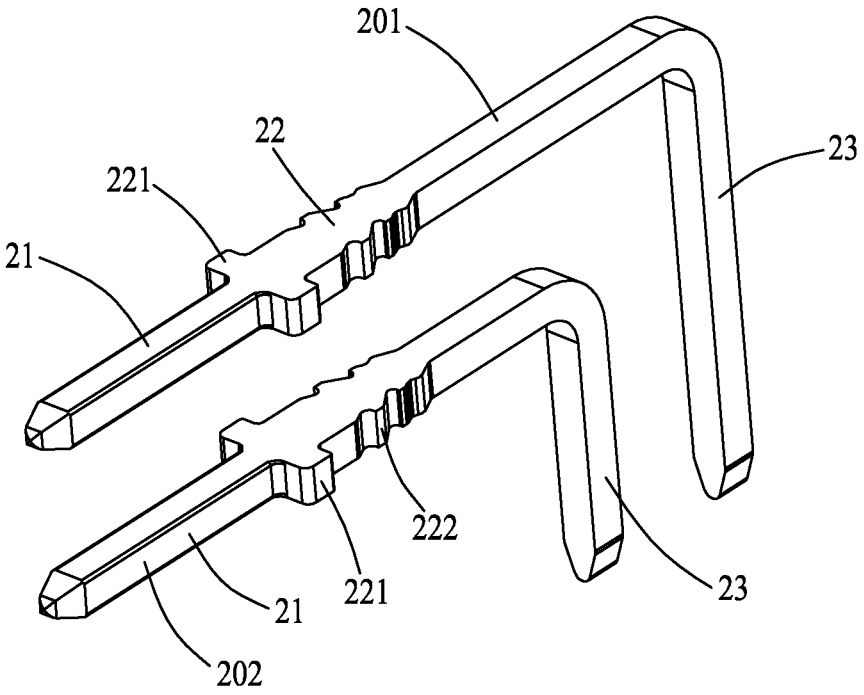
FIG. 5 is a perspective view of two electrical contacts as shown in FIG. 2.

Referring to FIG. 2 and FIG. 5 and conjunction with FIGS. 3-4, the electrical contacts 20 are received in the passageways 13 and soldering with the printed circuit board. Each electrical contact 20 comprises a contacting portion 21 for electrically connected with the complementary connector, a tail portion 23 electrically connected with the printed circuit board, and a main portion 22 connecting the contacting portion 21 with the tail portion 23. The contacting portions 21 are inserted into the corresponding passageways 13 and exposed in the mating cavity 14 for mating with the complementary connector. The main portion 22 and the tail portion 23 are extending beyond the corresponding passageway 13.

The main portion 22 each has a pair of wings 221 on both sides thereof. However, the pair of wings 221 are not necessary for the main portion 22 of every contact 20, according to actual requirements, the wings 221 can be only defined on the contacts 20 located on two sides and in the middle of a group of the electrical contacts 20, as long as the sealing member 30 can be remained in the mating cavity 14 stably. The main portion 22 having the wings 221 has a larger width than the corresponding passageway 13, thus the wings 221 can be positioned in the mating cavity 14. The main portion 22 each also has a plurality of barbs 222 on two sides thereof, and the barbs 222 are located behind the wings 221 for interferentially engaging with the passageways 13.

The contacts 20 are divided into a group of first contacts 201 on an upper row and a group of second contacts 202 on a lower row. The first contact 201 has a configuration approximately same as the second contact 202, and difference between the first contact 201 and the second contact 202 is: the second contact 202 has a smaller size of the main portion 22 and the tail portion 23 than the first contact 201, thus the first contacts 201 and the second contacts 202 are arranged with stepped distribution, for the tail portions 23 soldering to the printed circuit board conveniently. The tail portions 23 of the first contacts 201 and the second contacts 202 are extending and exposed out of the passageways 13.

Figure 6:
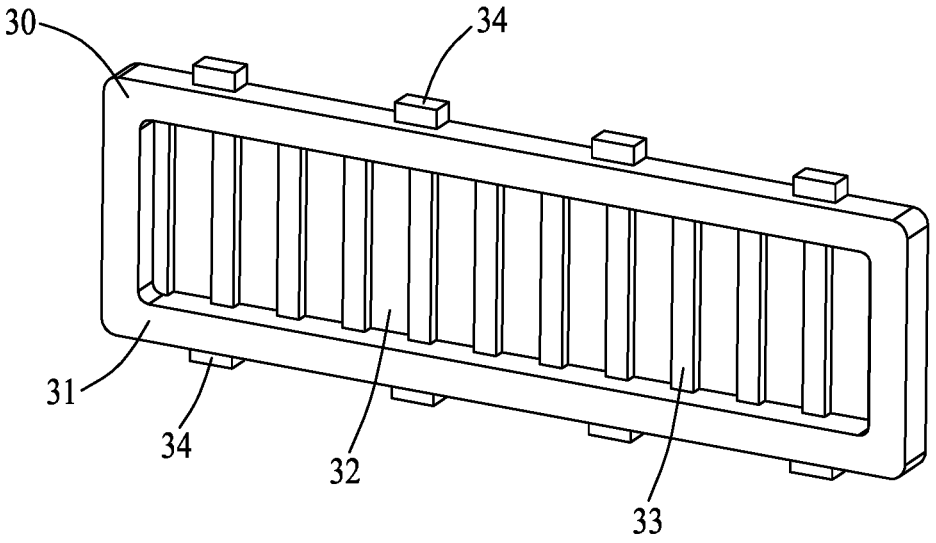
FIG. 6 is a perspective view of a sealing member shown in FIG. 2.
Figure 7:
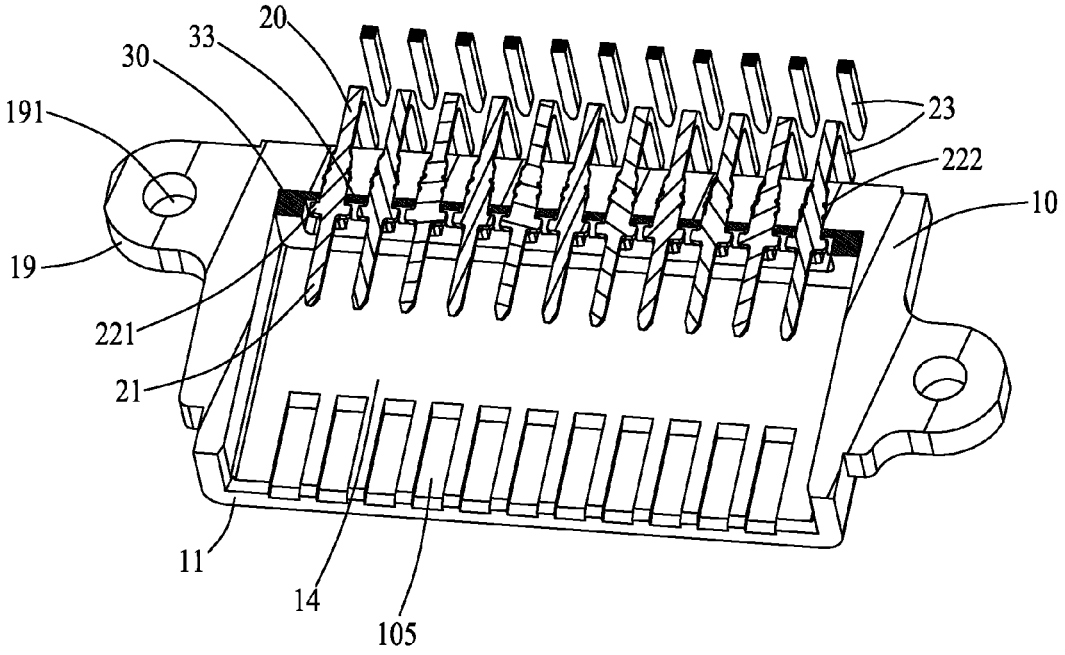
FIG. 7 is a cross-sectional view of the electrical connector taken along line 7-7 of FIG. 1.

Referring to FIGS. 6-7 and conjunction with FIG. 4, the sealing member 30 are received in the mating cavity 14 and fixed between the wings 221 and the mounting wall 12. The sealing member 30 comprises a base portion 31, a plurality of openings 32 defined in the base portion 31 for the tail portions 23 passing through, and a plurality of spacing portions 33, each spacing portions 33 is defined between the two neighboring openings 32. The base portion 31 is of frame shaped and surrounding the ribs 121. The opening 32 has a smaller width than the main portion 22 having the wings 221, for the wings 221 abutting against the corresponding spacing portion 33. Each spacing portion 33 is restricted by two neighboring ribs 121 and finally clamped between the wings 221 and the mounting wall 12. The base portion 31 defines a plurality of tabs 34 on both of a top edge and a bottom edge, and the tabs 34 are received in the corresponding limiting slots 18, to ensure the sealing member 30 fixed in the mating cavity 14 stably.

In assembly, the sealing member 30 is abutting against a front surface of the mounting wall 12, and the base portion 31 is encircling the ribs 121, the spacing portions 33 are restricted by corresponding two neighboring ribs 121, the tabs 34 are received in the corresponding limiting slots 18. Then the tail portions 23 are inserted into the corresponding openings 32 and passageways 13, and the spacing portions 33 are limited between the wings 221 and the mounting wall 12. Finally, tail portions 23 are bent at right angles to solder with the printed circuit board, thus the electrical connector 100 is assembled.

Figure 8:
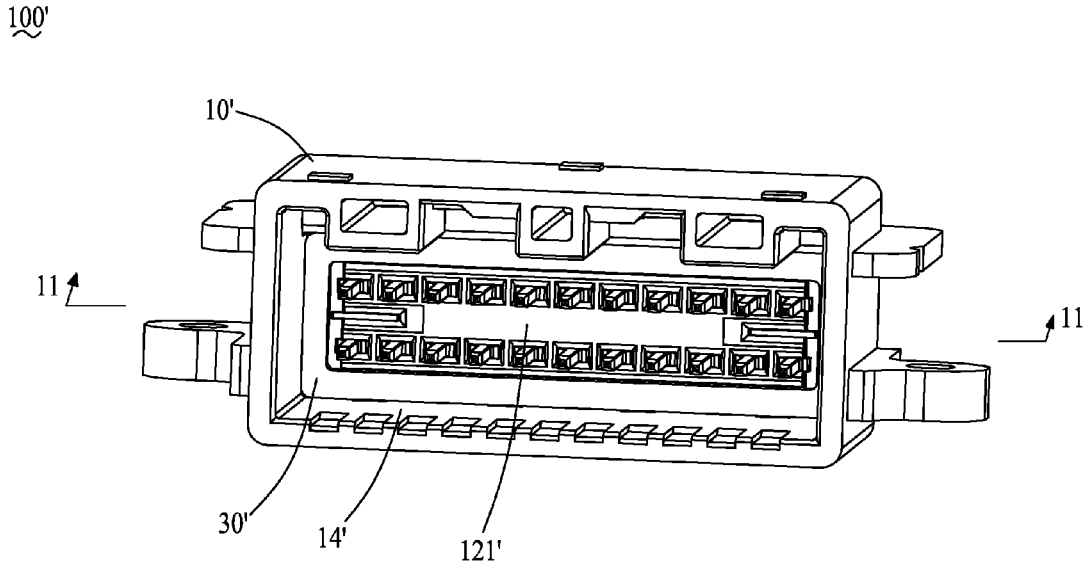
FIG. 8 is a perspective view of an electrical connector according to a second embodiment of present invention.

A second embodiment of the present invention is disclosed in FIG. 8, in this embodiment, the electrical connector 100' has a similar configuration as the electrical connector 100 shown in FIG. 1, and difference therebetween is a manner of a sealing member 30' assembling to an insulative housing 10'. Therefore, detailed description about the similar configuration is omitted here.

Figure 9:
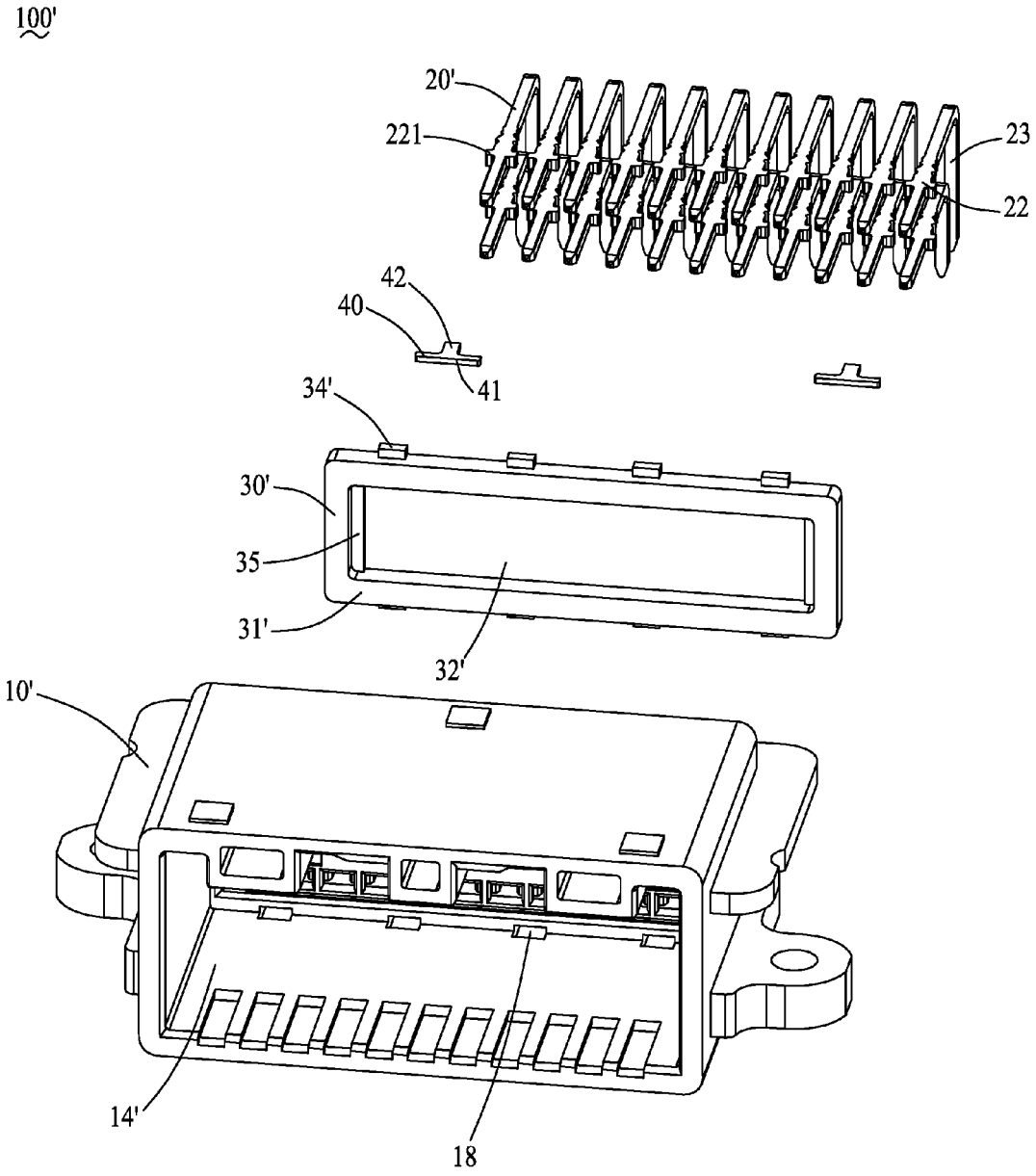
FIG. 9 is an exploded, perspective view of the electrical connector as shown in FIG. 8.
Figure 10:
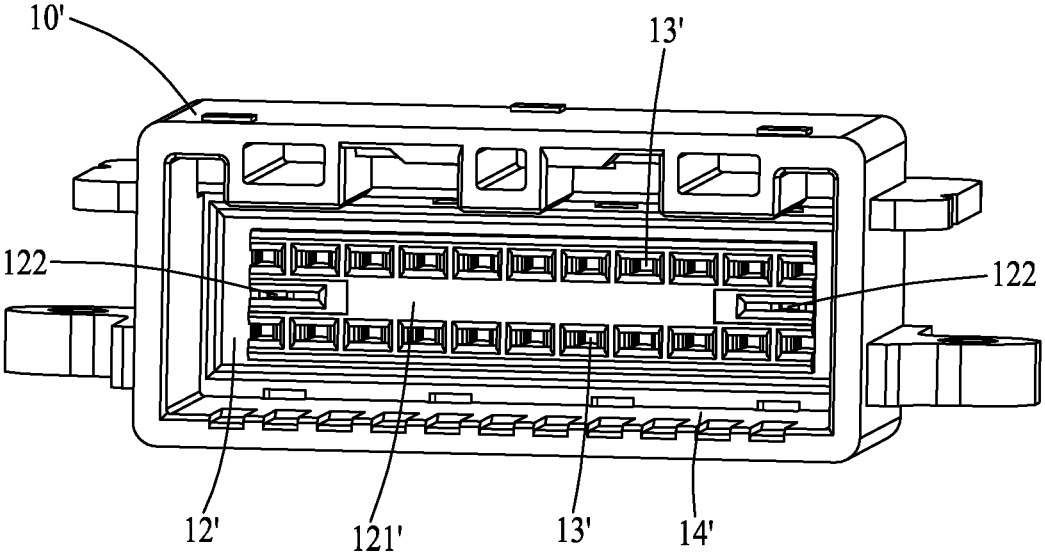
FIG. 10 is a perspective view of an insulative housing shown in FIG. 9.
Figure 11:
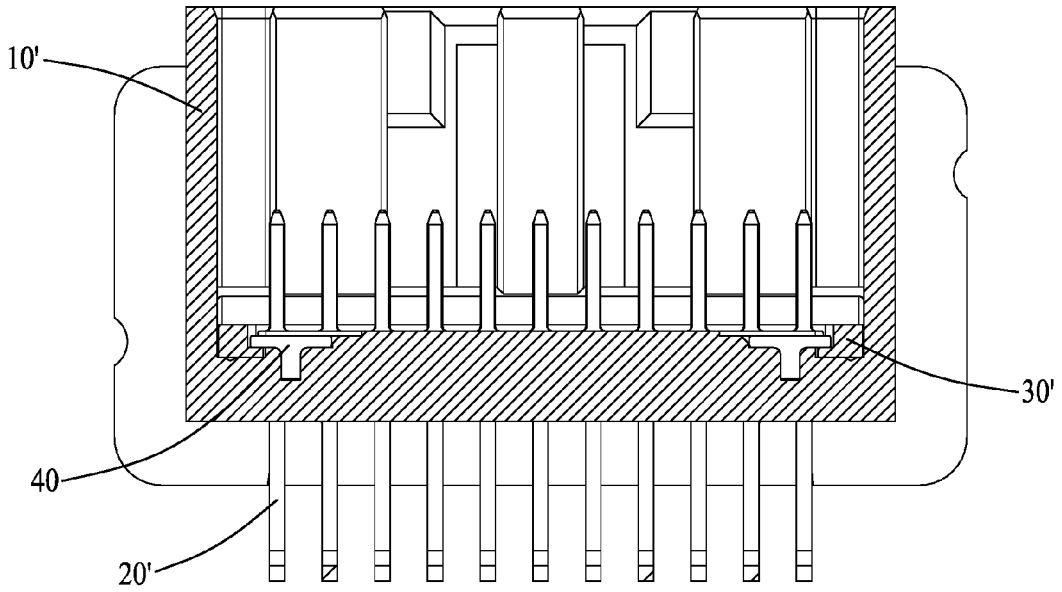
FIG. 11 is a cross-sectional view of the electrical connector taken along line 11-11 of FIG. 8.

Referring to FIGS. 9-11, The insulative housing 10' has a rib 121' extending forwards into a mating cavity 14' from a mounting wall 12', and two rows of passageways 13' are defined in the rib 121'. A pair of T-shaped slits 122 are defined on both sides of the rib 121', and the slits 122 are located between the two rows of passageways 13' along the height direction.

Each electrical contact 20' has a similar structure as the electrical contact 20, similarly, not every electrical contact 20' has a pair of wings 221 on both sides of the main portion 22, for example, only the two electrical contacts 20' on lateral sides each has a pair of wings 221 on the main portion 22, or the two electrical contacts 20' on lateral sides each has a wing 221 only on one side neighboring to a sealing member 30'.

The sealing member 30' is received in a mating cavity 14' and fixed between the wings 221 and the mounting wall 12'.

The sealing member 30' comprises a base portion 31', an opening 32' defined in the base portion 31' for the tail portions 23 passing through, and a plurality of tabs 34' on both of a top edge and a bottom edge, and the tabs 34' are received in the corresponding limiting slots 18, to ensure the sealing member 30' fixed in the mating cavity 14' stably. The base portion 31' is in a frame shape and surrounding the rib 121'. The rib 121' is accommodated in the opening 32', for tail portions 23 passing through the passageways 13'. The base portion 31' also defines a pair of locking portions 35 on both sides of the opening 32', and the locking portions 35 are extending towards each other to match with the corresponding wings 221. Each locking portion 35 is thinner than the base portion 31' for abutting against the corresponding wing 221.

The electrical connector 100' also has a pair of stop blocks 40 for limiting the sealing member 30', each stop block 40 defines a strip shaped body 41 and an extension portion 42 extending rearwards from the middle of body 41, thus the stop block 40 has a T-shaped configuration. The stop blocks 40 are received in the corresponding slits 122, and one end of each body 41 is abutting against the neighboring locking portion 35, thus the sealing member 30' is latched between the wings 221 and the mounting wall 12'.

During assembling, the sealing member 30' is abutting against a front surface of the mounting wall 12', and the base portion 31' is encircling the rib 121', the tabs 34' are received in the corresponding limiting slots 18. Then the tail portions 23 are inserted into the corresponding passageways 13', and the locking portions 35 are positioned between the wings 221 and the mounting wall 12'. Then the stop blocks 40 are inserted into the corresponding slits 122, to make sure the locking portions 35 fixed between the body 41 and the mounting wall 12'. Furthermore, tail portions 23 are bent at right angles to solder with the printed circuit board, thus the electrical connector 100' is assembled.

With contrast to current technology, the electrical connector 100, 100' defines a wing 221 on at least one side of the main portion 22 of one electrical contact 20, 20', thereby the sealing member 30, 30' being received in the mating cavity 14, 14' and limited between the wing 221 and the mounting wall 12, 12'. The sealing member 30, 30' of the electrical connector 100, 100' could be fixed in the mating cavity 14, 14' without any auxiliary element, and have a better waterproof performance.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

The invention claimed is:

1. An electrical connector for mounting to a printed circuit board and mating with a complementary connector, comprising:

an insulative housing defines a front face for mating with the complementary connector and a mounting wall opposite to the front face, a mating cavity formed between the front face and the mounting wall for accommodating the complementary connector, a plurality of passageways penetrating through the mounting wall along a mating direction;

a plurality of electrical contacts received in the corresponding passageways, and each electrical contact comprising a contacting portion for electrically connected with the complementary connector, a tail portion electrically connected with the printed circuit board, and a main portion connecting the contacting portion with the tail portion, each main portion defining a plurality of barbs on both sides thereof for interferentially engaging with the corresponding passageway; and a sealing member received in the mating cavity, and having a base portion and at least one opening defined in the base portion for tail portions of electrical contacts passing through; wherein at least one electrical contact defines a wing on one side thereof, and the sealing member is restricted between the wing and the mounting wall.

2. The electrical connector as claimed in claim 1, wherein at least two contacts on both sides define the wing on the main portion thereof, and the main portion having the wing has a larger width than the corresponding passageway.

3. The electrical connector as claimed in claim 1, wherein the wing is in front of the corresponding barbs.

4. The electrical connector as claimed in claim 1, wherein the sealing member defines a plurality of tabs on both of a top edge and a bottom edge, the insulative housing comprises a top wall, a bottom wall, a left side wall and a right side wall connecting the top wall with the bottom wall to form the mating cavity, a plurality of limiting slots are disposed in a conjunction area between the mounting wall and the top wall, and a conjunction area between the mounting wall and the bottom wall, for receiving the corresponding tabs.

5. The electrical connector as claimed in claim 4, wherein each of the left side wall and the right side wall defines an ear portion on an outer surface thereof, for installing the electrical connector on the printed circuit board, and the two ear portions are disposed diagonally on both sides of the insulative housing.

6. The electrical connector as claimed in claim 5, wherein each ear portion defines a through hole extending along a height direction.

7. The electrical connector as claimed in claim 1, wherein the mounting wall defines at least one rib extending forwards into the mating cavity, and the passageways are defined in the rib, and the base portion is surrounding and abutting against the rib.

8. The electrical connector as claimed in claim 7, wherein the base portion defines a plurality of openings and a plurality of spacing portions, and each spacing portions is defined between the two neighboring openings, the mounting wall has a plurality of ribs, and each spacing portion is restricted by two neighboring ribs and clamped between the wing and the mounting wall.

9. The electrical connector as claimed in claim 7, wherein the base portion defines a pair of locking portions extending towards each other to match with the wing, and each locking portion is thinner than the base portion, the locking portions are positioned between the wing and the mounting wall.

10. The electrical connector as claimed in claim 7, wherein a pair of T-shaped slits are defined on both sides of the rib, and the slits are located between two rows of the passageways along a height direction.

11. The electrical connector as claimed in claim 10, further comprising a pair of stop blocks for limiting the sealing member, wherein each stop block is of T-shaped, defines a strip shaped body and an extension portion extending rearwards from the middle of body.

12. The electrical connector as claimed in claim 11, wherein the stop blocks are received in the corresponding slits, and one end of each body is abutting against the neighboring locking portion.

13. The electrical connector as claimed in claim 8, wherein the passageways are divided into two rows along a height direction of the insulative housing, the ribs are aligned with the corresponding passageway, and each rib is divided into three segments by two relative passageways along the height direction.

* * * * *